US012110679B2

(12) United States Patent
Berg

(10) Patent No.: US 12,110,679 B2
(45) Date of Patent: Oct. 8, 2024

(54) LOAD TRANSFERRING CONNECTING ELEMENT

(71) Applicant: Svein Berg Holding AS, Åndalsnes (NO)

(72) Inventor: Svein Berg, Isfjorden (NO)

(73) Assignee: Svein Berg Holding AS, Åndalsnes (NO)

( * ) Notice: Subject to any disclaimer, the term of this patent is extended or adjusted under 35 U.S.C. 154(b) by 104 days.

(21) Appl. No.: 17/792,286

(22) PCT Filed: Jan. 21, 2021

(86) PCT No.: PCT/EP2021/051294

§ 371 (c)(1),
(2) Date: Jul. 12, 2022

(87) PCT Pub. No.: WO2021/148513

PCT Pub. Date: Jul. 29, 2021

(65) Prior Publication Data

US 2023/0056986 A1 Feb. 23, 2023

(30) Foreign Application Priority Data

Jan. 22, 2020 (NO) ..... 20200079

(51) Int. Cl.
*E04B 1/41* (2006.01)
*E04G 21/14* (2006.01)

(52) U.S. Cl.
CPC ..... *E04B 1/41* (2013.01); *E04G 21/142* (2013.01)

(58) Field of Classification Search
CPC ..... E04B 1/4114; E04B 1/4107; E04B 1/41; E04G 21/142
See application file for complete search history.

(56) References Cited

U.S. PATENT DOCUMENTS 3,993,341 A 11/1976 Bentley
8,881,487 B2 * 11/2014 Berg ..... E04B 1/415 52/250

(Continued)

FOREIGN PATENT DOCUMENTS

CN 101715501 A 5/2010
CN 205476156 U 8/2016

(Continued)

OTHER PUBLICATIONS

International Search Report issued in Application No. PCT/EP2021/051294 mailed on May 10, 2021 (5 pages).

(Continued)

*Primary Examiner* — Adriana Figueroa
(74) *Attorney, Agent, or Firm* — Osha Bergman Watanabe & Burton LLP

(57) ABSTRACT

A load-transferring connecting element establishes a connection between a first building element and a second building element. The load-transferring connecting element is adapted for transfer of force between the first and second building elements. The load-transferring connecting element includes an elongated box-shaped main body. A first end portion of the load-transferring connecting element is arranged for attachment into the first building element with a remaining second end portion of the load-transferring connecting element positioned so as to project from the first building element. The second end portion is adapted for being received in a cavity arranged in the second building element. The second end portion of the load-transferring connecting element is provided with an attachment area for attaching lifting equipment for handling of the first building element.

8 Claims, 5 Drawing Sheets

(56) References Cited

U.S. PATENT DOCUMENTS

| | | | | |
|---|---|---|---|---|
| 9,828,762 | B2 * | 11/2017 | Berg | E06B 1/68 |
| 2003/0110715 | A1 | 6/2003 | Hansort | |
| 2008/0279620 | A1 * | 11/2008 | Berg | F16B 7/042 403/178 |
| 2010/0313518 | A1 | 12/2010 | Berg | |
| 2012/0096800 | A1 | 4/2012 | Berg | |

FOREIGN PATENT DOCUMENTS

| | | | |
|---|---|---|---|
| CN | 106062293 | A | 10/2016 |
| CN | 205907926 | U | 1/2017 |
| CN | 206273934 | U | 6/2017 |
| CN | 206554428 | U | 10/2017 |
| CN | 107642207 | A | 1/2018 |
| CN | 207330116 | U | 5/2018 |
| CN | 207330117 | U | 5/2018 |
| CN | 207511675 | U | 6/2018 |
| CN | 109025291 | A | 12/2018 |
| CN | 209194876 | U | 8/2019 |
| DE | 4439999 | A1 | 5/1996 |
| DE | 19700765 | A1 | 7/1998 |
| DE | 20010427 | U1 | 10/2001 |
| NO | 323943 | B1 | 7/2007 |
| NO | 328275 | B1 | 1/2010 |
| NO | 337777 | B1 | 6/2016 |
| WO | 2009/017417 | A1 | 2/2009 |
| WO | 2015/132702 | A1 | 9/2015 |

OTHER PUBLICATIONS

Written Opinion issued in Application No. PCT/EP2021/051294 mailed on May 10, 2021 (7 pages).
Norwegian Search Report issued in U.S. Appl. No. 20/200,079 mailed on Aug. 20, 2020 (2 pages).
Office Action issued in counterpart Chinese Patent Application No. 202180010231.9 mailed on Jun. 27, 2023 (10 pages).

* cited by examiner

LOAD TRANSFERRING CONNECTING ELEMENT

The present application relates to a load transferring connecting element for establishing a connection between a first building element and a second building element. Furthermore, the application relates to a building system comprising the first building element and the second building element and at least one load-transferring connecting element It is common today to use prefabricated building elements when building both large and small buildings. Different types of building elements such as wall elements, floor elements, stair elements, etc. are then produced in factories that are adapted for the production of different building elements and the finished building elements are transported to the construction site where they are installed as respective parts of a building built on site.

A number of devices exist for joining these building elements, and one category of these interconnection systems are systems that are not visible when the building elements are brought together. Typically, box elements may be used where one end of the box element is molded into one building element, while the other end is inserted into a cavity in the other building element and fixed to this by molding that end into the cavity. The present invention belongs to this latter category of joints.

The invention may be used with different types of building elements, but will have its typical application when installing prefabricated stairs. Prefabricated stairs are usually manufactured by a molding process where the steps are facing down into the mold and the back of the stairs is facing out. The stair units are designed with stair noses in the molding process. The stair noses have a shape that fits with corresponding recesses in a stair landing for positioning and holding the stair units to the stair landing in the installation position. When the stair unit has been mold, it is lifted out of the mold and to perform this operation, lifting wires/chains are used which are attached to four lifting sleeves, usually two on each side of the back of the stair. The stair unit must then be turned over and when the stairs are to be maneuvered into the installation position in the building, this is done by attaching three or four lifting chains to lifting recesses which are designed in the stair steps. The stair unit is placed with the stair noses in the recesses of the stair landing and there molded into place.

When installing a stair unit, there are also challenges concerning the relative positioning between the stair unit itself and the stair landing. The building of the stair landing is completed when the stair unit is to be installed. It is important that the stair landing and the upper and/or lower steps have the same horizontal positioning when the stair unit is installed so that there is no level difference between the upper and/or lower steps and the adjacent stair landing. In order to achieve that the stair unit is positioned flush with the stair landing, washers so-called shims may be used to adjust the stair unit in line with the stair landing.

As an alternative to molded stair noses, load-carrying box elements that may be molded into the upper and lower part of the stair unit are currently used. Each box element is molded into the stair unit so that one end of it projects freely from the stair unit. During installation, these free ends are inserted into recesses in the stair landings. Any difference between the horizontal level of the stair unit and the stair landing is adapted with an adjustable screw which is arranged in the free end of the box element, before the recesses are filled with concrete mass and molded to the stair landing.

The process steps comprising molding the stair unit during prefabrication, lifting the stair unit out of the mold and installing the stair unit in position relative to the stair landing by means of lifting cables, are time consuming and costly. It should be mentioned here in particular, that the need for separate lifting brackets to lift the finished molded stair unit out of the mold and the subsequent need for using other lifting brackets to position the stair unit next to the stair landing, are time and cost driving factors that contribute to enhancing the cost of the process.

Against this background, it is an object of the present invention to provide a solution which may simplify and streamline the handling and maneuvering both when lifting the stair unit from the mold and when installing the stair unit in a position adjacent to a stair landing at the upper and/or lower step. Furthermore, it is a further object that the solution facilitates that the upper and/or lower step may be adapted to the horizontal position of the stair landing.

This object is achieved with the invention as defined in the independent patent claims. Further embodiments of the invention are defined in the dependent claims.

The invention concerns a load-transferring connecting element for connecting a first building element and a second building element. The load transfer element is adapted for the transfer of load/forces between the two building elements. The first building element may comprise a stair unit and the second building element may comprise a stair landing, but also other kind of building elements where a connection is to be established are relevant, and especially prefabricated building elements. The load-transferring connecting element according to the invention comprises an elongated box-shaped main body. A first end portion of the load-transferring connecting element is adapted for attachment, for example by being molded or embedded into the first building element, typically the stair unit. The remaining second end portion of the load-transferring connecting element then projects from this first building element, and is adapted for being received in a cavity arranged in the second building element, typically the stair landing. The second end portion of the load transferring connecting element is arranged with an attachment area for attaching lifting equipment. The lifting equipment must be used for handling the first building element, which may then typically be the stair unit.

The attachment area may be designed in different ways, and may be designed as an attachment hole. The attachment hole may then be arranged for attaching attachment means such as an attachment screw or attachment bolt which in turn is connected to at least one elongated lifting body. Alternatively, other types of attachment means may be used, for example a locking part may be fastened to the load-carrying connecting element and the second locking part to the lifting equipment. The first and second locking part may be fastened and loosened depending on whether a lifting operation is to be performed or not.

In these aspects of the invention a simple solution is provided for lifting a building part, this solution is also time and cost saving compared to existing technique. The solution is particularly advantageous when used on a stair unit to be installed next to a stair landing. By including attachment areas for attaching lifting equipment to the load-transferring connecting element, it is thus no longer necessary to use separate attachment means to perform the lifting, as has been usual in the past. In addition, the load-transferring connecting element may also be used as a lifting point when the stair unit is to be lifted out of the mold.

The second end portion of the load transferring connecting element is provided with an adjusting device. This adjusting device is adapted to regulate the relative height between the first building element and the second building element when receiving the load-transferring connecting element in the cavity of the second building element. When the stair unit is positioned next to the stair landing, it happens that there is a difference in height between adjacent steps and stair landings. It is then particularly advantageous that the load-transferring connecting element is equipped with an adjusting device for regulating the adjacent step steps of the stair unit so that it is flush with the surface of the stair landing.

It is an advantage of the present invention, compared to the prior art, that the load-transferring connecting element to be used to connect the stair unit and the stair landing also has the possibility of combining attachment of lifting equipment and adjustment of level difference between stair landing and adjacent steps.

In one embodiment, the adjusting device may comprise a screw device which is adjustably arranged in a screw hole which is arranged in the load-transferring connecting element, for instance in a side wall of the load-transferring connecting element. Adjustment of the screw in the screw hole thus regulates the height of the step in relation to the stair landing.

To ensure force transfer from the load-transferring connecting element and into the first building element, the first end portion of the load-transferring connecting element may be arranged with a reinforcement arrangement. The first end portion of the load-transferring connecting element may be provided with at least one of the following reinforcing elements;

- a plate structure comprising two main surfaces and a plurality of side surfaces where the plate structure is attached with one of its main surfaces to the main body so that the end opening of the first end portion is covered and the plate structure projects perpendicularly from the main body,
- a transverse element attached to the first end portion of the load transferring connecting element and having an orientation where the longitudinal axis of the transverse element is positioned transverse to the longitudinal axis of the load transferring connecting element.

Furthermore, the invention also relates to a building system comprising the first building element and the second building element and at least one load-transferring connecting element as described above. The first building element may then typically comprise a stair unit and the second building element may typically comprise a stair landing. The at least one load transfer element may be positioned so as to protrude from a side surface of the stair unit and into the cavity arranged in a side surface of the stair landing.

The building system may further comprise a lifting equipment comprising a plurality of elongated lifting bodies such as lifting chains or lifting wires, each comprising attachment means for attachment to an attachment area arranged on the projecting second portion of the load transfer member. The stair unit may be lifted and maneuvered by means of the lifting equipment so that it is placed in the installation position next to the stair landing.

The number of load-transferring connecting elements that the stair unit is equipped with may vary. At least two connecting elements may be mounted projecting from a side surface at the lower step of the stair unit and at least two load-transferring connecting element may be mounted projecting from a side surface at the upper step of the stair unit.

In the following, an example of the invention will be described with reference to the accompanying figures, in which FIG. 1 shows a stair shaft seen from above where a stair unit is lifted into place with lifting chains which are connected to a load-transferring connecting element according to the invention.

Figure 1:
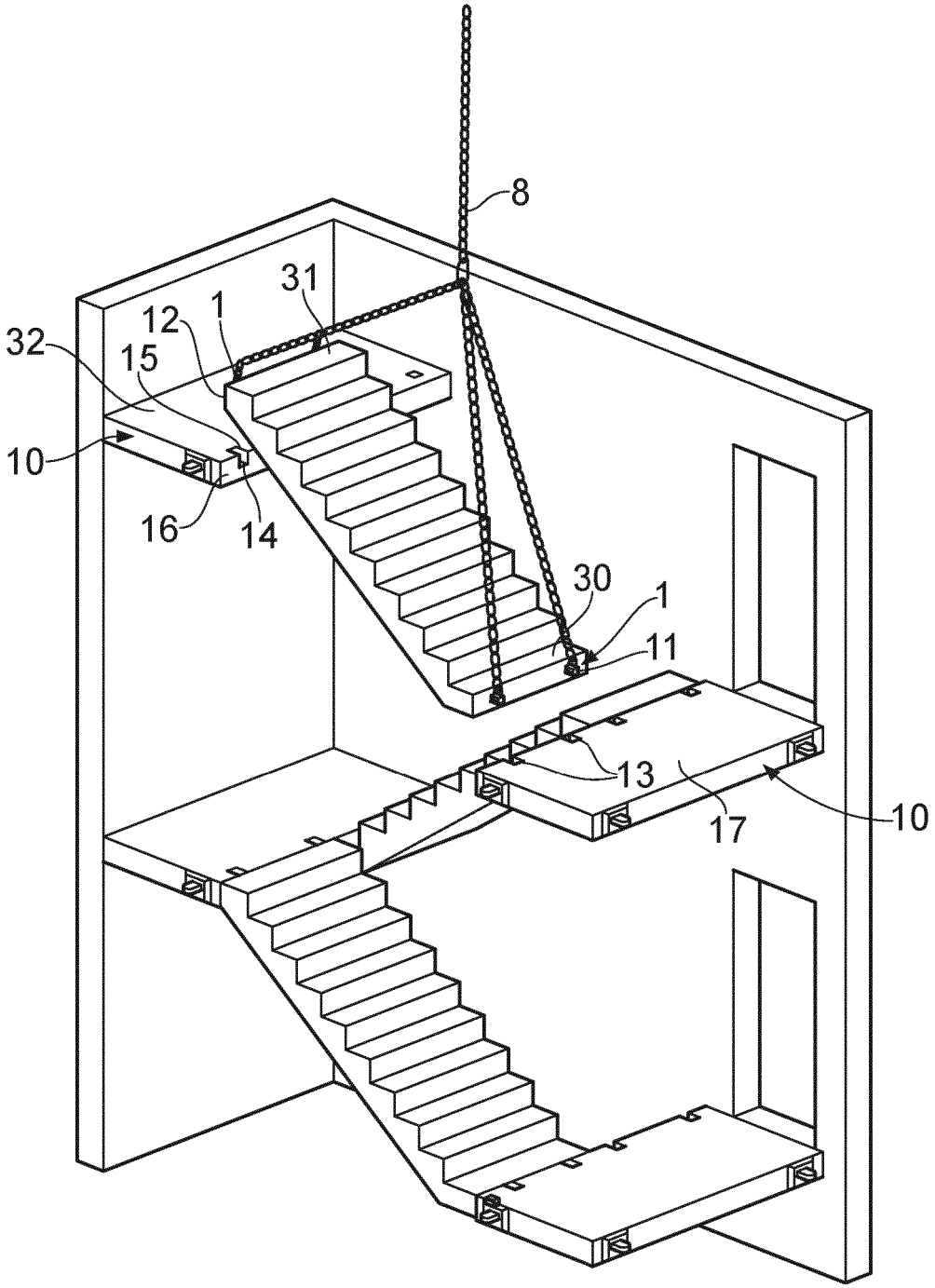
Figure 2:
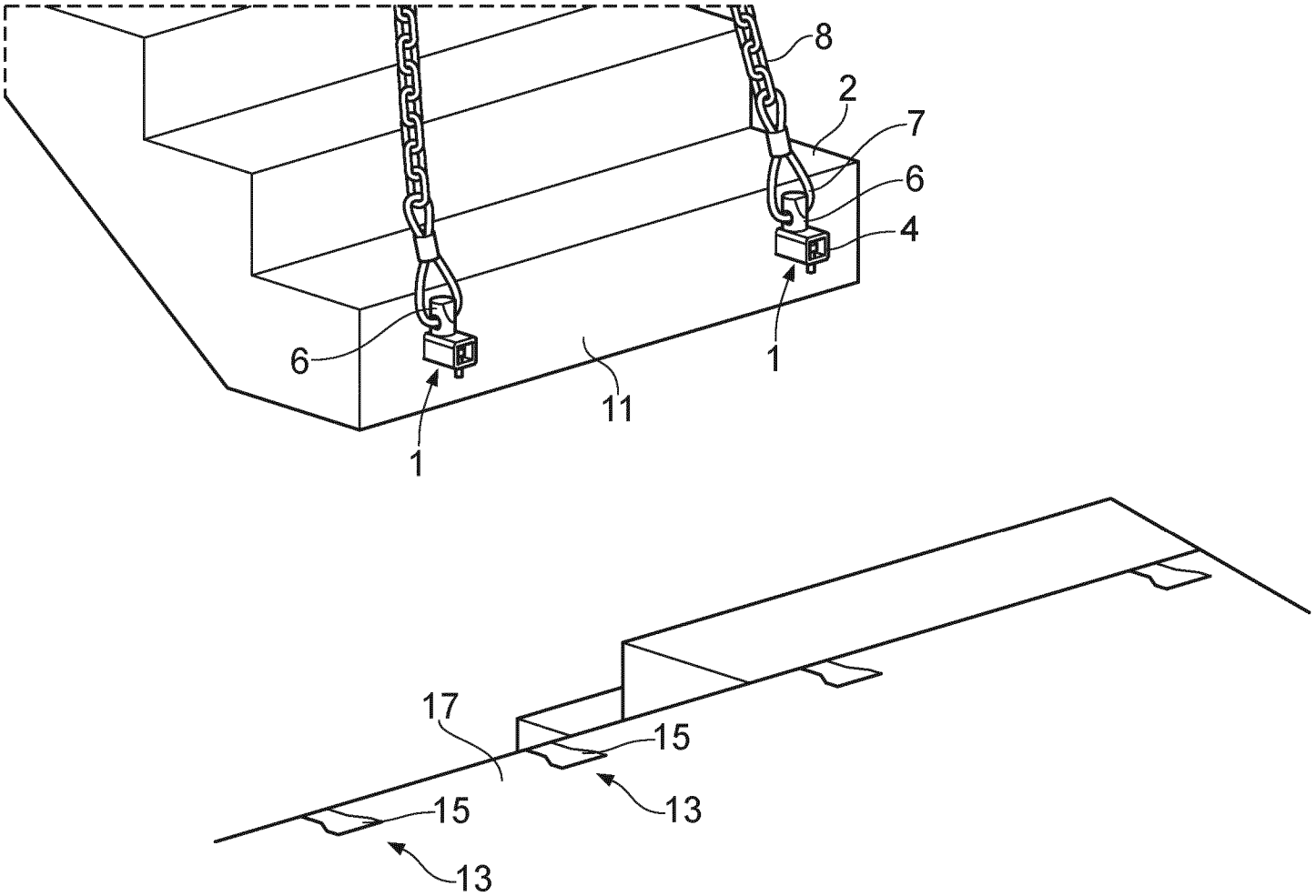
FIG. 2 shows the load transfer element attached to the stair unit.
Figure 3:
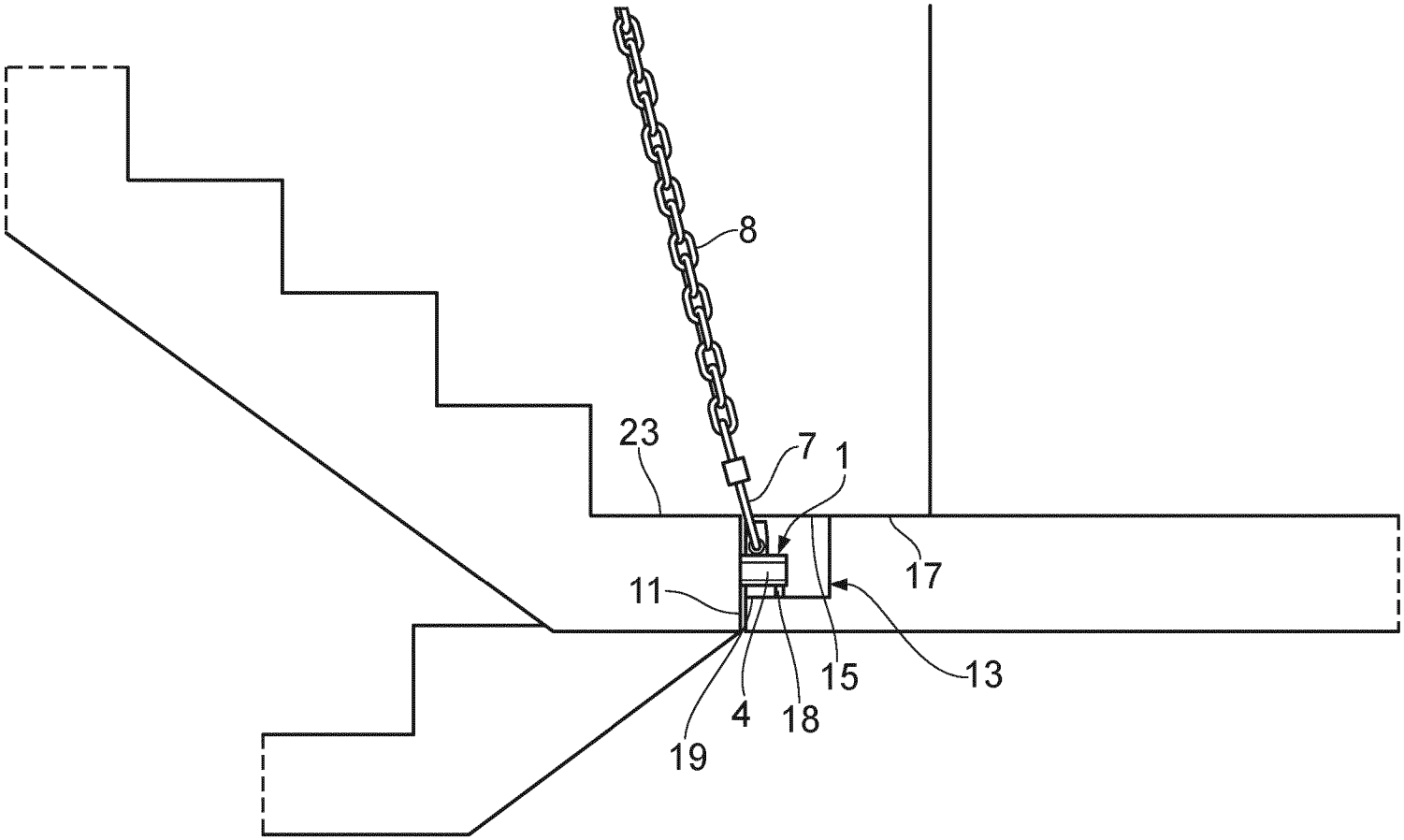
FIG. 3 shows the stair unit in the installed position with the load transfer element accommodated in a cavity in a stair landing.
Figure 4:
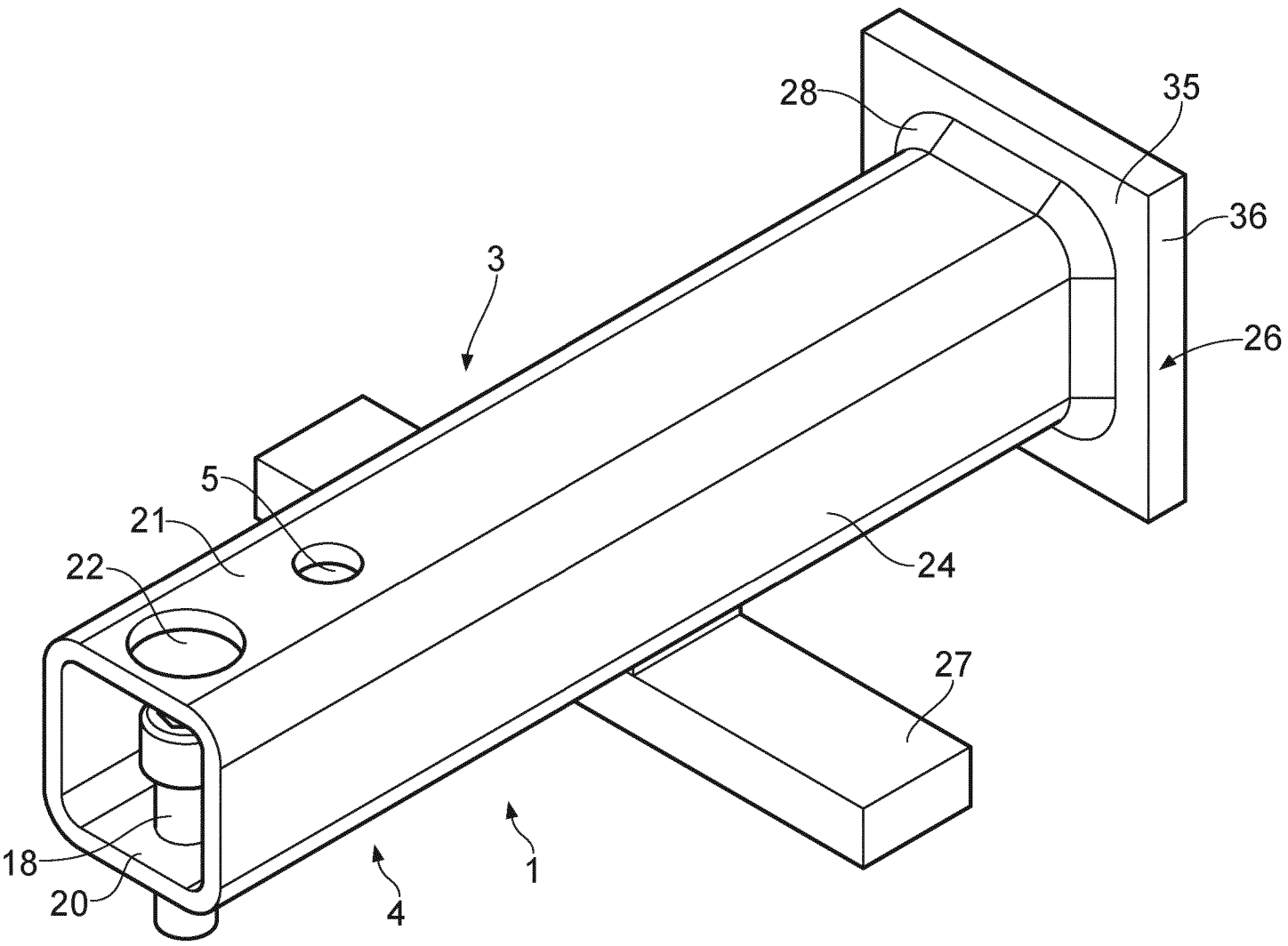
FIG. 4 shows a detailed view of the load transferring element in perspective.

The load-transferring element 1 according to the invention is in FIGS. 1-3 shown molded into a first building element such as a stair unit 2. A first end portion 3 of the load-transferring element 1 is embedded in the stair unit 2, while the remaining second end portion 4 projects from the stair unit as it appears in the figures. The second end portion 4 is provided with an attachment area 5 in the form of an attachment hole, see FIG. 4, for receiving attachment means 6 such as an attachment screw. An intermediate piece 7 in the form of a wire loop ensures a connection between the attachment screw and a lifting chain for lifting the stair unit to the installation position between two stair landings 9,10 in a staircase.

The stair unit 2 shown in the figures has two load-transferring elements 1 positioned projecting from a side surface 11 at a lower part of the stair unit 2. Two further load-transferring elements 1 are arranged at the upper part of the stair unit 2, with other end portions 4 projecting from a side surface 12. The stair landings have cavities 13 each for receiving a load transfer element. Each cavity 13 has a side opening 14 in the side surface 16 of the stair landing and a top opening 15 in the top surface 17 of the stair landing to facilitate the insertion and receiving of the load transfer element in the cavity 13. The side surface 12 of the stair unit will be positioned parallel to the stair unit side surface 16 between two stair landings 9, 10.

Figure 5:
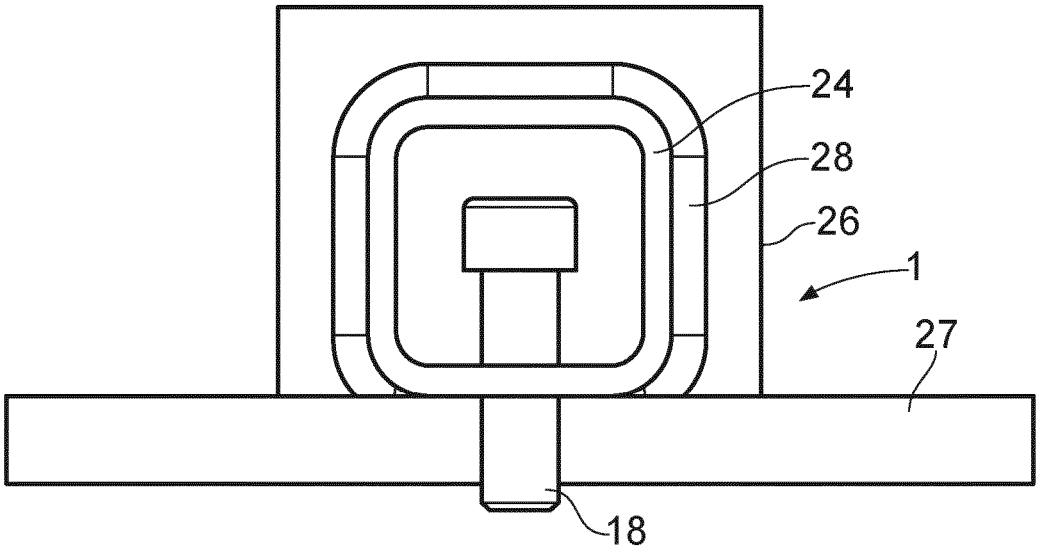
FIG. 5 is a front view of the load transferring element of FIG. 4.

When the stair unit 2 is placed with the load-transferring elements 1 accommodated in the cavities 13, as illustrated in FIG. 3, the load-transferring element 1 rests at an adjusting device in the form of a screw device 18 against the bottom 19 of the cavity 13. The screw device 18 is mounted in a screw hole in a lower side wall of the load transfer element 1, see also FIGS. 4 and 5, and may be adjusted up and down by a suitable screw tool (not shown) which is inserted through an access opening 22 arranged in the upper side wall 21 of the load transfer element 21. The screw 18 is adjusted to adjust the stair unit 2 so that the lower stair step 30 is flush with the top surface 17 of the stair landing. The same procedure is performed for adjusting the upper stair step 31 in alignment with the top surface 17 of the stair landing. Then the attachment means 6 shown here is loosened by the attachment screw, from the attachment area 5, shown here by the attachment hole. The lifting chain 8 may be removed and the cavity 13 may be filled with filling mass, preferably molding mass or other suitable filling mass for joining the stair unit 2 and the stair landing. The load transfer element 1 is adapted for the transfer of forces between the stair landing and the stair unit 2.

The load transfer element 1 has an elongated box-shaped main body. The main body 24 is shown with a square profile where the corners are rounded. It is of course also possible to use other profile shapes such as oval, circular, rectangular etc. Two reinforcement elements are attached to the main body 24; a plate structure 25 and a transverse element 27. It is of course possible to arrange for the reinforcement by other means than the two reinforcement elements shown here. The reinforcing elements are placed on the first portion of the load transferring element 1 and are thereby molded into the stair unit 1.

The plate structure 26 has two main surfaces 35 and four side surfaces 36, and is attached with one of its two main surfaces to the main body 24 so that the end opening of the first portion 3 is covered and the plate structure 24 projects perpendicularly from the main body 24. The plate structure is fixed with a weld 28 to the main body 24. The area of the main side of the plate structure 26 facing the main body 24 is larger than the area of the profile of the box-shaped main body 24, and the plate structure 26 thus projects from the main body 24. The transverse element 27 is arranged as a massive piece with an elongated shape with a rectangular cross-section. The transverse element 27 is fixed at the lower edge of the lower side surface of the load-transferring element 1 and is oriented so that the longitudinal axis of the transverse element 27 is oriented transversely to the longitudinal axis of the load-transferring connecting element 1, with a portion of the transverse element 27 projecting on each side of the main body 24.

The invention claimed is:

1. A load-transferring connecting element for establishing a connection between a first building element and a second building element and which is adapted for transfer of force between the first and second building elements, the load-transferring connecting element comprising an elongated box-shaped main body, wherein a first end portion of the load-transferring connecting element is arranged for attachment into the first building element with a remaining second end portion of the load-transferring connecting element positioned so as to project from the first building element, wherein the second end portion is adapted for being received in a cavity arranged in the second building element, wherein the second end portion of the load-transferring connecting element is provided with an attachment area for attaching lifting equipment for handling of the first building element, and wherein the first end portion is provided with a reinforcement arrangement to ensure transfer of forces between the load-transferring connecting element and the first building element, the reinforcement arrangement comprising a transverse element attached to the main body along the first end portion of the load-transferring connecting element and having an orientation where a longitudinal axis of the transverse element is positioned transversely to a longitudinal axis of the load-transferring connecting element.

2. The load-transferring connecting element according to claim 1, wherein the second end portion of the load-transferring connecting element is arranged with an adjusting device adapted for adjusting a relative height between the first building element and the second building element when receiving the load-transferring connecting element in the cavity of the second building element.

3. The load-transferring connecting element according to claim 1, wherein the attachment area comprises an attachment hole for attachment means which are connected to the lifting equipment.

4. The load-transferring connecting element according to claim 2, wherein the adjusting device comprises a screw device which is adjustably arranged in a screw hole arranged in the load-transferring connecting element.

5. The load-transferring connecting element according to claim 1, wherein the reinforcement arrangement further comprises:

a plate structure comprising two main surfaces and a plurality of side surfaces, the plate structure being fixed with one of the main surfaces to the main body so that an end opening of the first end portion is covered and the main surfaces protrude perpendicularly from the main body.

6. A building system comprising a first building element and a second building element and at least one load-transferring connecting element for establishing a connection between a first building element and a second building element, wherein the at least one load-transferring connecting element is adapted for transfer of force between the first and second building elements, the load-transferring connecting element comprising an elongated box-shaped main body, wherein a first end portion of the load-transferring connecting element is arranged for attachment into the first building element with a remaining second end portion of the load-transferring connecting element positioned so as to project from the first building element, wherein the second end portion is adapted for being received in a cavity arranged in the second building element, wherein the second end portion of the load-transferring connecting element is provided with an attachment area for attaching lifting equipment for handling of the first building element, wherein the first building element comprises a stair unit and the second building element comprises a stair landing where the at least one load-transferring connecting element projects from a side surface of the stair unit and into the cavity arranged in a side surface of the stair landing, and wherein the first end portion is provided with a reinforcement arrangement to ensure transfer of forces between the load-transferring connecting element and the first building element, the reinforcement arrangement comprising a transverse element attached to the main body along the first end portion of the load-transferring connecting element and having an orientation where a longitudinal axis of the transverse element is positioned transversely to a longitudinal axis of the load-transferring connecting element.

7. The building system according to claim 6, wherein the building system comprises lifting equipment comprising a plurality of elongated lifting bodies, wherein each elongated lifting body comprises attachment means for attachment to the attachment area provided on the projecting second end portion of the load-transferring connecting element.

8. The building system according to claim 6, wherein at least two load-transferring connecting elements are mounted projecting from a side surface at a lower step of the stair unit and at least two load-transferring connecting element are mounted projecting from a side surface at an upper stair step of the stair unit.

* * * * *